United States Patent [19]

Braun et al.

[11] Patent Number: 4,951,486

[45] Date of Patent: Aug. 28, 1990

[54] NESTED PADDLE LOCK ASSEMBLY

[75] Inventors: Jack A. Braun, Brunswick; Michael J. Rachocki, Columbia Station, both of Ohio

[73] Assignee: Cleveland Hardware & Forging, Cleveland, Ohio

[21] Appl. No.: 443,734

[22] Filed: Nov. 7, 1989

[51] Int. Cl.[5] ..... E05B 13/10

[52] U.S. Cl. ..... 70/208; 292/DIG. 31

[58] Field of Search ..... 70/208; 292/7, 36, DIG. 31; D8/338, 302, 306

[56] References Cited

U.S. PATENT DOCUMENTS

| | | | |
|---|---|---|---|
| 2,055,688 | 9/1936 | Halinka | 70/248 |
| 2,402,748 | 6/1946 | Schroeder | 70/248 |
| 3,044,815 | 7/1962 | Soss | 70/208 |

*Primary Examiner*—Robert L. Wolfe

*Attorney, Agent, or Firm*—Calfee, Halter & Griswold

[57] ABSTRACT

A nested paddle lock assembly comprises inside and outside pan assemblies mounted in alignment with one another on a door and respectively having inside and outside selectively pivotal paddle handles, slide means in said door selectively linearly actuated by either handle when pulled, pivotal lever means pivoted by said linearly moving slide means upon handle actuation to unlatch said door, spring means to return the pivotal lever means, slide means and handles to their respective normally closed positions and lock means selectively actuated from inside or outside the door either to lock the door by obstructing slide means movement or to unlock the door by allowing slide means movement.

17 Claims, 7 Drawing Sheets

NESTED PADDLE LOCK ASSEMBLY

FIELD OF THE INVENTION

The present invention relates in general to a paddle lock assembly for a vehicle door or the like and in particular to a nested paddle lock assembly having inner and outer pan assemblies in alignment with one another and having a locking mechanism comparatively carried by those nested pan assemblies operative to directly lock or unlock the nested paddle lock assembly from either inside or outside the door.

BACKGROUND OF THE INVENTION

Padded lock assemblies utilizing paddle handles are well known in the industry for use on vehicle doors or the like. Conventionally, the inside pan assembly and outside pan assembly are positioned in offset spaced relationship from one another on the vehicle door. Rod links are connected to and extend between the inside and outside pan assemblies for transmitting and controlling the actuation and locking functions therebetween. In addition, rod or cable links extend between one of these pan assemblies and the rotary latch(es) on the door for selectively releasing the latch from the strike bar on the door jam when either paddle handle is actuated.

The conventional paddle lock assemblies have a number of moving parts and are rather complex in their construction. The rod links extending between the inner and outer pan assemblies are difficult and time consuming to install. In addition, if maintenance is required, the entire door may have to be disassembled in order to fix the conventional paddle lock assemblies.

SUMMARY OF THE INVENTION

The principal object of the present invention is to provide a nested paddle lock assembly that is easy to install and easy to maintain. For this purpose, the inner and outer pan assemblies of the present invention are respectively mounted on the inner and outer door walls or panels in aligned or nested relationship relative to one another. The inner pan assembly has no rod links connected thereto and may be easily removed from the door totally independently of the outer pan assembly. This independent removal allows easy maintenance on the inner pan assembly and easy access through the door to the outer pan assembly.

It is another object of the present invention to provide a locking mechanism on the nested paddle lock assembly which may be selectively actuated from outside or inside the door to either directly block the slide mechanism of the assembly to lock the door or to provide the slide mechanism with freedom of movement to unlock the door. For this purpose, the locking mechanism includes a locking pin which may be selectively pivoted into a position blocking slide assembly movement to lock the door from its inside or outside. This locking pin on the locking mechanism eliminates the conventionally employed locking linkages extending between the pan assemblies. When the inside pan is independently removed from the outside pan, the entire locking mechanism is fully exposed for easy service and maintenance.

It is still another object of the present invention to provide a nested paddle lock assembly having a slide assembly selectively actuated by the paddle handle on either the inner or outer pan assembly. The slide assembly is spring biased to its home or closed position to normally bias the inner and outer paddle handles into their retracted positions within their respective pan assemblies. The spring biasing of the handles to their retracted positions reduces rattling of the handles within the pan assemblies to provide a quieter ride.

The invention, then, comprises the features hereinafter fully described and particularly pointed out in the claims, the following description and annexed drawings setting forth in detail certain illustrative embodiments of the invention, these being indicative, however, of but a few of the various ways in which the principles of the invention may be embodied.

DETAILED DESCRIPTION OF THE PREFERRED EMBODIMENT

Figure 1:
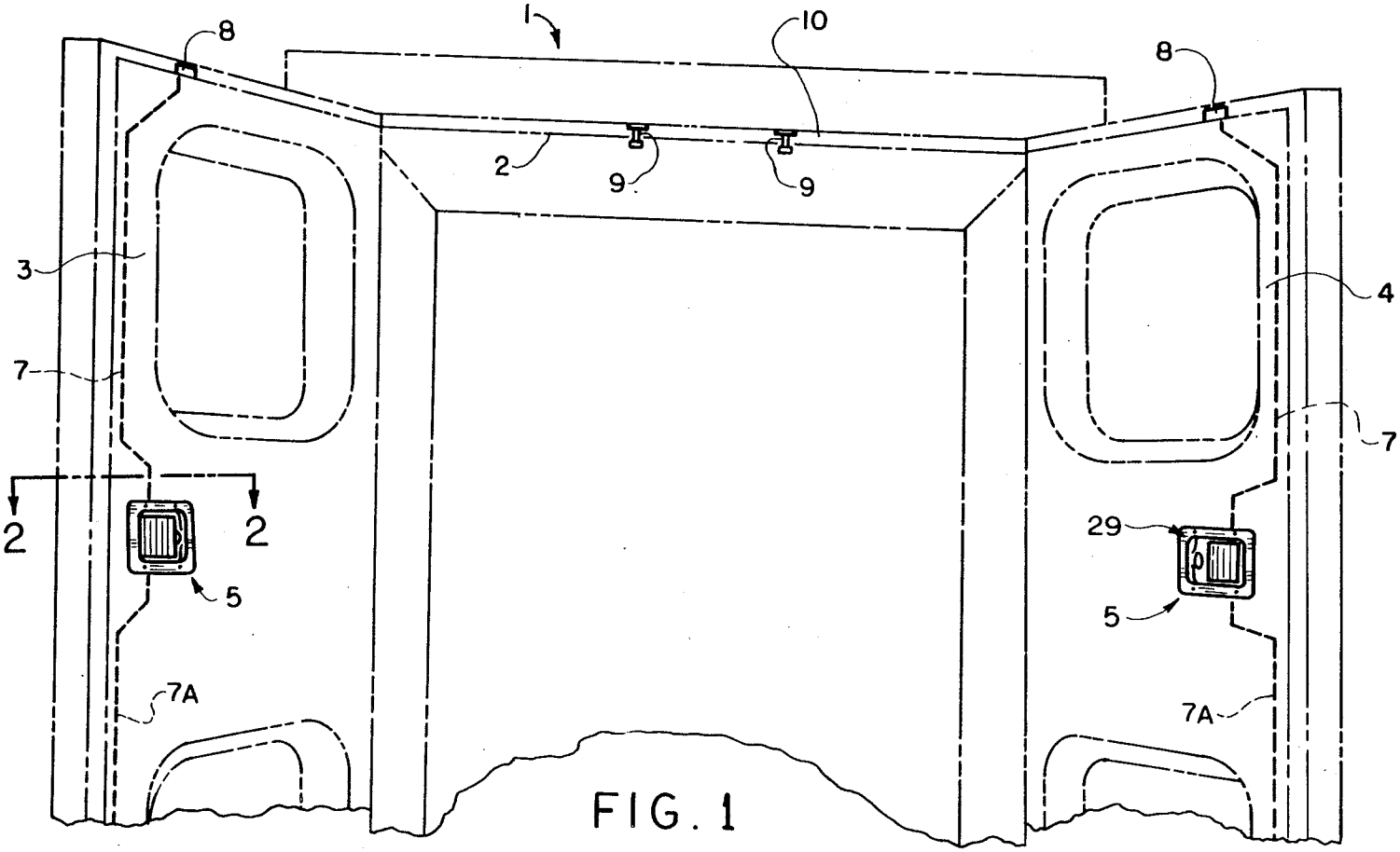
FIG. 1 is a perspective view looking into the back of a vehicle through its open double back doors, each of said doors having the nested paddle lock assembly of the present invention mounted therein.

Turning now in more detail to the drawings and initially to FIG. 1, a vehicle, indicated generally at 1, such as an ambulance or the like, has a large rear opening 2 selectively covered by two cooperating hinged doors 3 and 4. These doors 3 and 4 each have the nested paddle lock assembly of the present invention, indicated generally at 5, mounted therein. Although the nested pivotal lock assemblies 5 are illustrated as being mounted in both doors, it will be appreciated that the lock assembly could be mounted in only one active locking door having an outer flange thereon comparatively overlapping an innerflange on the other door in their respectively closed positions to hold both doors in the closed and latched position.

The nested paddle lock assembly 5 is operative through plural cable or rod link means 7 and 7A attached thereto and extending therefrom to operate conventional rotary latches 8 at the top and bottom of the door. These rotary latches 8 respectively cooperate with strike bars 9 mounted in alignment therewith on the upper and lower door jams 10. When the doors are closed, the rotary latches 8 are in surrounding latched relationship to the strike bars 9 to secure the doors in their respective closed positions. When the nested paddle lock assemblies are handle actuated, the rotary latch means are also actuated by the cable or rod links 7 and 7A to unlatch the door to allow the same to be swung to its open position about its hinges. The actuation of the nested paddle lock assembly 5 is obtained by selective pivotal rotation of either the inside or outside paddle handle when the nested paddle lock assembly is in its unlocked position as will be more apparent from the detailed description of the nested paddle lock invention set forth below.

Figure 2:
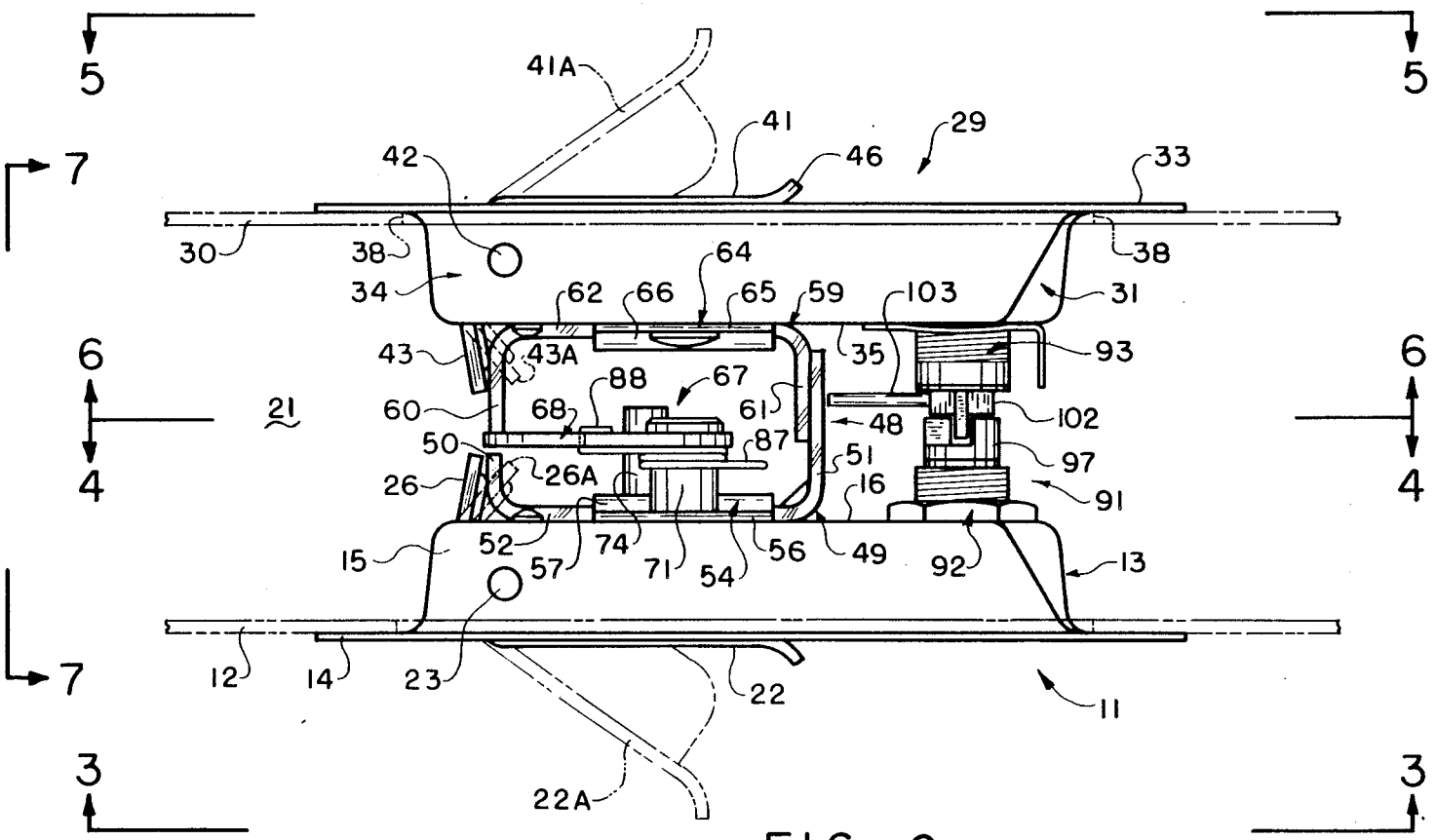
FIG. 2 is a plan view of the nested paddle lock assembly mounted in the vehicle door, with the locking mechanism being show in its locked condition, as taken generally along the plane 2—2 of FIG. 1.
Figure 3:
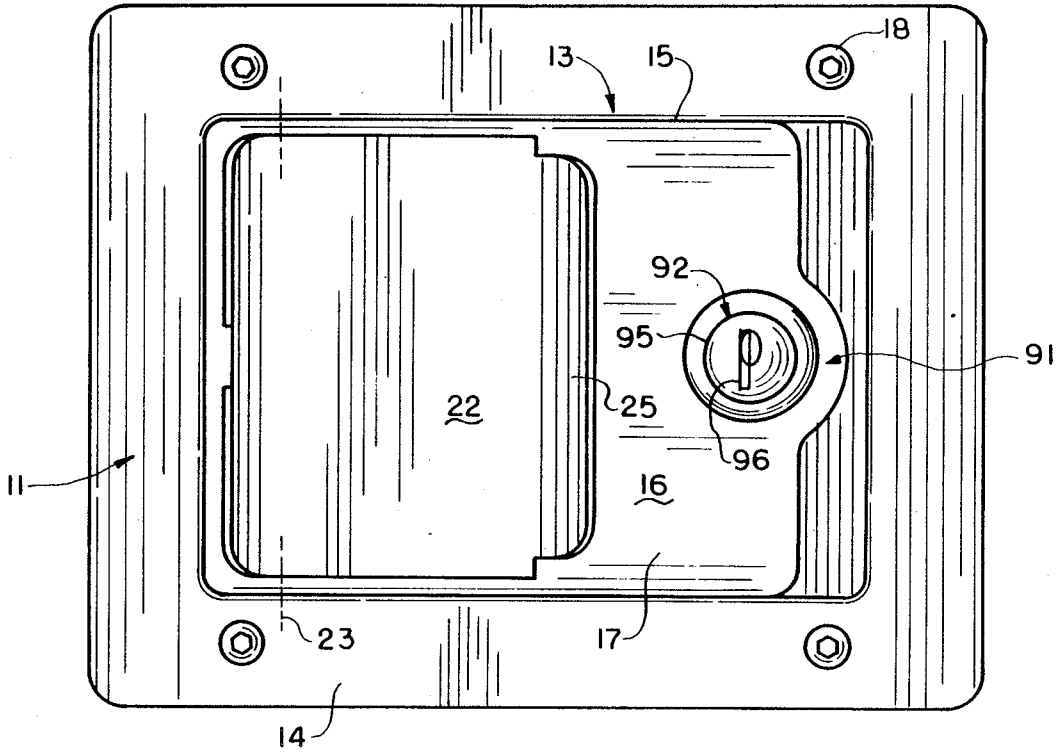
FIG. 3 is an elevation of the outside pan assembly from the outside of the vehicle as taken generally along the plan 3—3 of FIG. 2, showing the outside pivotal paddle handle and the outside key lock actuator.

Turning now to FIGS. 2 and 3, the outside pan assembly, indicated generally at 11, includes a first pan, indicated generally at 13, having an integrally formed peripheral attachment skirt 14, inwardly extending and interconnected sidewalls 15 and a base wall 16 at the bottom thereof. The interconnected sidewalls 15 and base wall 16 cooperatively form a well 17 therewithin.

The first pan assembly 13 is mounted to the outside wall or panel 12 of door 3 by fasteners 18 passing through apertures in the attachment skirt 14 into the outside wall 12 of door 3. The sidewalls 15 and base wall 16 of the first pan 13 extend through an opening in outside wall 12 of door 3 into the internal cavity 21 of door 3.

The first pan assembly 11 includes an outside paddle handle 22 pivotally secured to the sidewalls 15 of the first pan 13 by a pivotal shaft connection 23. The outside paddle handle 22 is normally received within the well 17 of the first pan 13 in a retracted position and includes an outwardly turned manipulation flange 25 to assist in manually gripping and actuating the same.

Figure 4:
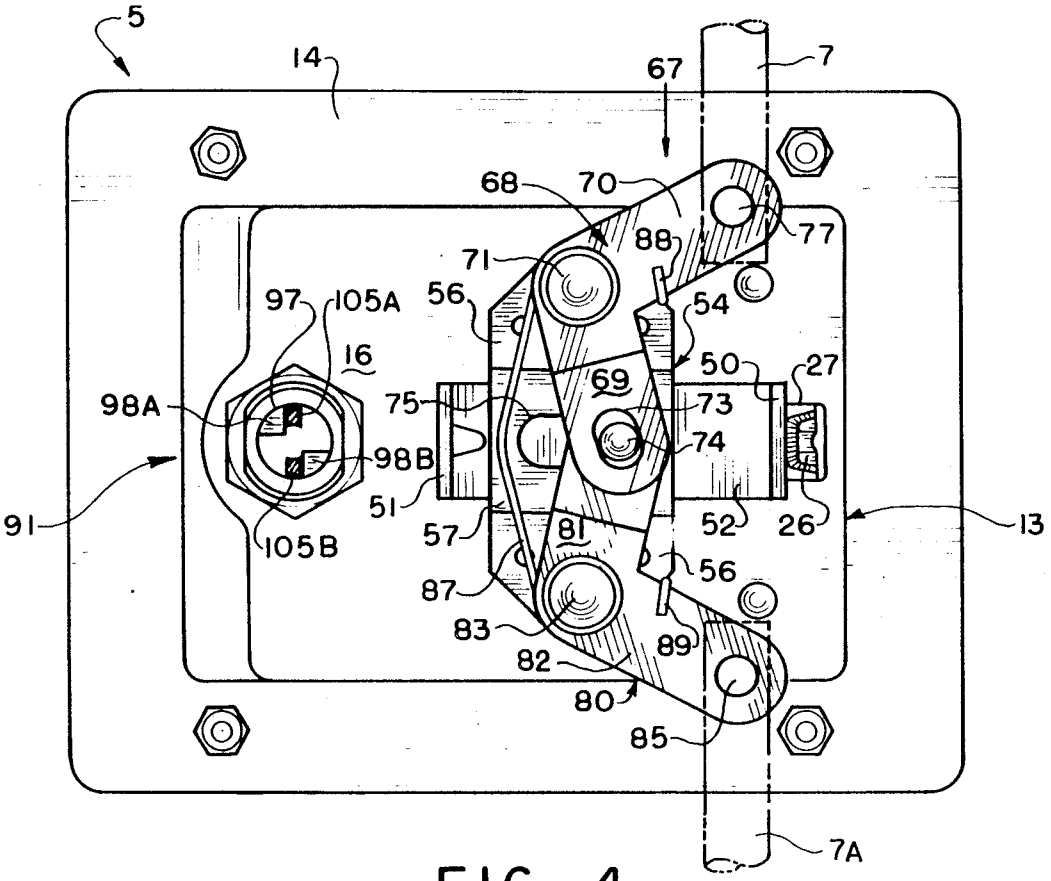
FIG. 4 is an elevation of the pivotal actuation finger, slide means and pivotal lever means mounted on the inside of the outside pan assembly as taken from the internal cavity of the door generally along plane 4—4 of FIG. 2.

The outside pivoted paddle handle 22 has a first actuation finger 26 integrally formed therewith on the opposite side of pivot shaft 23. Such actuation finger 26 extends through a slot 27 in the base wall 16 of first pan 11, as best shown in FIG. 4. When outside paddle handle 22 is manually pivoted outwardly from the first pan assembly 11 to the position illustrated in the dotted lines 22A of FIG. 2, the first actuation finger 26 will also be pivoted about the pivot shaft 23 to the dotted line position 26A shown in FIG. 2. This pivotal movement of the outside paddle handle 22 and first actuation finger 26 selectively actuates the slide assembly in the unlocked condition of the assembly as will be described in more detail hereinafter.

Figure 5:
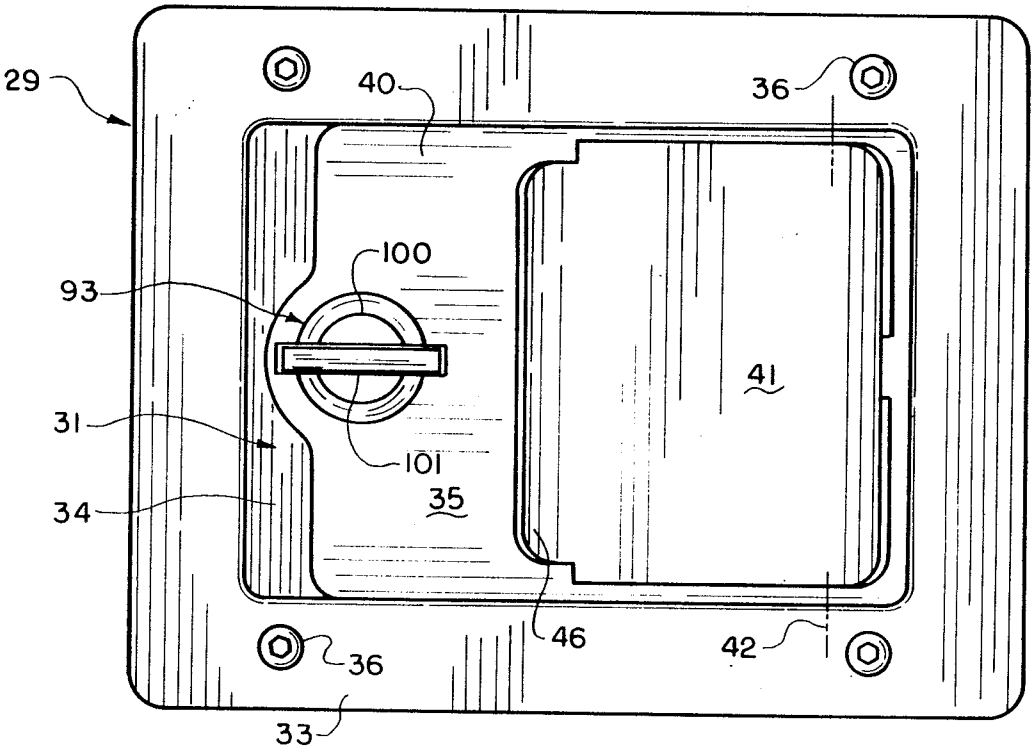
FIG. 5 is an elevation of the inside pan assembly, as taken from the inside of the vehicle generally along the plane 5—5 of FIG. 2.
Figure 6:
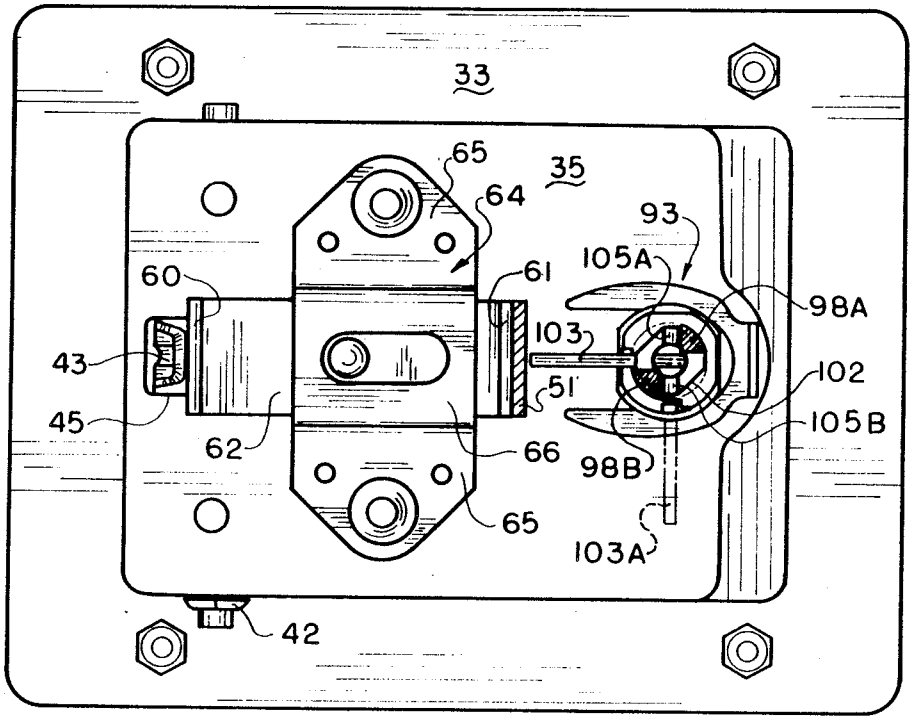
FIG. 6 is an elevation of the inside pan assembly, with the unlocked condition of the locking pin of the locking mechanism being shown in dotted lines, as taken from the internal cavity of the door generally along the plane 6—6 in FIG. 2.

The nested paddle lock assembly of the present invention also includes a second, inside pan assembly indicated generally at 29. As is best shown in FIGS. 2, 5 and 6, the inside pan assembly 29 is mounted on and extends within the inside wall or panel 30 of door 3. The outside wall 12 and inside wall 30 cooperatively define therebetween the door cavity 21.

The inside pan assembly 29 includes a second or inside pan, indicated generally at 31, having an integrally formed peripheral attachment skirt 33, interconnected sidewalls 34, and a base wall 35 at the bottom thereof. The peripheral attachment skirt 33 overlies the internal surface of inside wall 30 and is secured thereto by fasteners 36 passing through spaced holes in peripheral skirt 33 and extending into inner wall 30. The inside pan assembly 29 is mounted on the door in direct "nested" alignment with the outside pan assembly 11, as best shown in FIG. 2.

The interconnected sidewalls 34 and base wall 35 extend through a hole 38 in inside wall 30 of door 3 into the cavity 21 thereof. The sidewalls 34 and base wall 35 cooperatively define a well 40 therewithin normally receiving substantially all of the second or inside paddle handle 41 in its retracted position.

The inside paddle handle 41 is pivotally secured to the sidewall 34 of second pan 31 by a pivot shaft 42. The inner paddle handle 41 has an inwardly extending second actuation finger 43 integrally formed therewith on the opposite side of pivot shaft 42. As best shown in FIGS. 2 and 6, the second actuation finger 43 extends through a slot 45 in the bottom wall 35 of second or inside pan 31.

The second or inner paddle 41 includes an inwardly bent distal manipulation flange 46 to assist in gripping and pivotally actuating such handle. The inner paddle handle 41 can be selectively pivotally moved away from the second pan assembly 29 to the dotted line position 41A illustrated in FIG. 2. Such pivotal movement of the inner second paddle handle 41 to the position 41A will result in the integrally formed second actuation finger 43 being pivotally moved to the dotted line position 43A illustrated in FIG. 2. Such pivotal movement of the second actuation finger 43A also linearly drives the slide assembly to unlatch the door when the nested paddle lock assembly is in its unlocked condition, as will be described in more detail below.

The slide assembly, indicated generally at 48 in FIG. 2, includes a first generally U-shape slide member, indicated generally at 49 mounted for linear reciprocal movement relative to first pan 13. The first generally U-shape slide member 49 includes an actuation flange 50, an abutment flange 51 and a base slide member 52 extending therebetween and being integrally formed therewith. The first slide member 49 is slidably mounted to the base wall 16 of first pan 13 for selective reciprocal rectilinear movement relative thereto.

For this purpose, the first actuation flange 50 on first slide member 49 is in endwise engagement with the first actuation finger 26 on outside paddle handle 22. Pivotal movement of first actuation finger 26 to the right as viewed in FIG. 2 will drive the first actuation flange 50 and thus the first slide member 49 to the right as also viewed in FIG. 2 in its unlocked condition.

This rectilinear sliding movement of the first slide member 49 relative to first pan assembly 11 is guided by a guide plate, indicated generally at 54. The guide plate 54 includes two spaced attachment flanges 56 having apertures therethrough to receive fasteners to secure the same to the base wall 16 of the first pan 13. The first guide plate 54 also includes a centrally formed U-shape channel 57 positioned between attachment flanges 56. The channel 57 has the base slide member 52 of first slide member 49 extending therethrough. The base slide member is cooperatively guided and supported by channel 57 and base wall 16.

The first abutment flange 51 is longer than the first actuation flange 50 as is apparent in FIG. 2. Such first abutment flange 51 selectively cooperates with a second abutment flange on the second slide member of the slide assembly 48.

Such second slide member, indicated generally at 59, includes a second actuation flange 60, a second abutment flange 61 and a second base slide member 62 extending therebetween and being integrally formed therewith. The second slide member 59 is slidably mounted to the base wall 35 of second pan 31 for selective reciprocal linear movement relative thereto.

Figure 7:
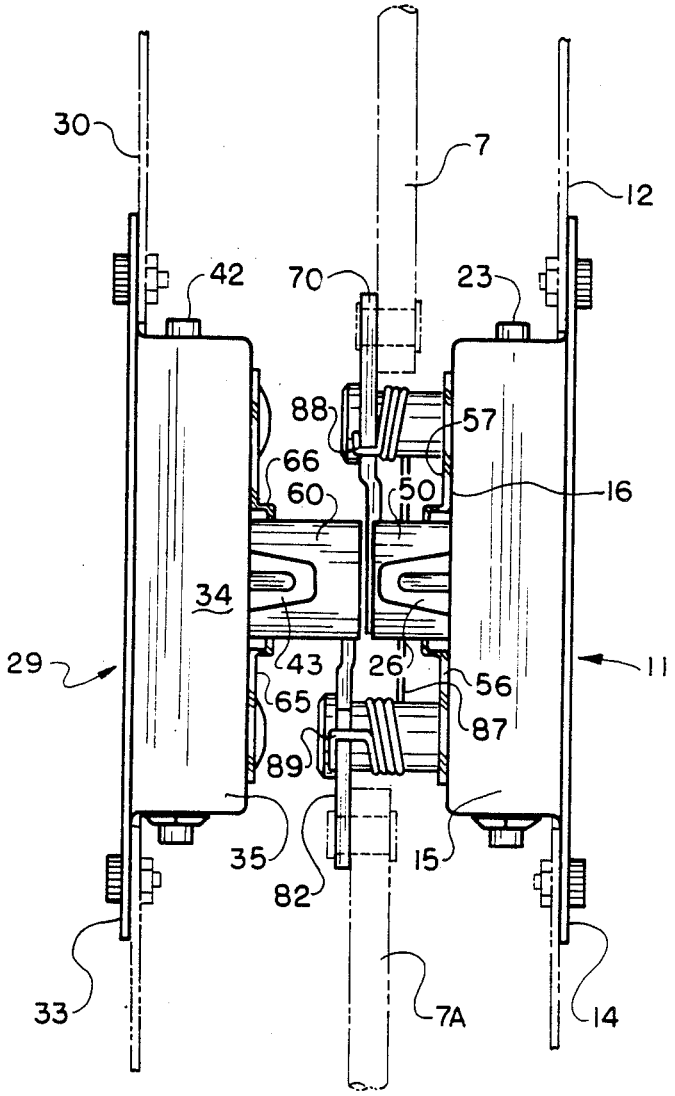
FIG. 7 is an end view of the nested paddle lock assembly mounted in the door as taken generally along the plane 7—7 of FIG. 2.

For this purpose, the second actuation flange 60 is in endwise engagement with the second actuation finger 43. In their respective normal or "closed positions", as shown in FIG. 2, the second actuation flange 60 is in alignment with the first actuation flange 50, but is spaced therefrom as best shown in FIG. 7. When the locking mechanism is unlocked and the second paddle handle 41 is pivoted away from second pan 31, to its dotted line position 41A, the second actuation finger 43 pivots to its dotted line position 43A to linearly drive the second slide member 59 to the right as viewed in FIG. 2.

The second slide member 59 is mounted to the base wall 35 of second pan 31 for this selective reciprocal linear movement by a second guide plate, indicated generally at 64. This second guide plate member 64 includes two spaced attachment flanges 65 at its ends having apertures therethrough to receive fasteners to secure the same to the bottom surface of base wall 35. The second guide plate member includes a central U-shape guide channel 66 positioned between flanges 65 and integrally formed therewith. The base slide member 62 slidingly extends through the U-shape channel 66. The base slide member 62 is cooperatively captured and guided by the channel 66 and base wall 35. Linear movement of second slide member 59 to the right as viewed in FIG. 2 is operative to drive the first slide member 49 to the right.

To this end, the second abutment flange 61 on second slide member 59 is equal to or longer than the second actuation flange 60 as best shown in FIG. 2. Because second base member 62 is shorter than first base member 52, second abutment flange 61 overlaps first abutment flange 51 and is positioned directly behind and normally in contact with such first abutment flange 51. Therefore, when second abutment flange 61 moves to the right as viewed in FIG. 1, it will drive first abutment flange 51 and thus first slide member 49 to the right to actuate the pivotal lever assembly of the present invention.

As best shown in FIG. 4, such pivotal lever assembly, indicated generally at 67, includes a first L-shape pivot lever, indicated generally at 68. The first pivotal lever 68 includes an integrally formed first actuation arm 69 and first operator arm 70. The first pivot lever 68 is pivotally mounted to the first pan by an inwardly extending pivot post 71 on first guide plate 54. This pivot post 71 is positioned adjacent the proximal ends of the actuation arm 69 and operator arm 70 at the intersection thereof, whereby such arms are free to pivot about such post upon actuation.

For this purpose, the first actuation arm 69 has an elongated slot 73 adjacent its distal end. Such elongated slot 73 receives therein an upstanding actuation pin 74 connected to and extending inwardly from the base slide 52 of first slide member 49. Such actuation pin 74 extends inwardly through an elongated slot 75 in the guide channel 57 of first guide plate 54. This slot 75 allows the pin 74 to move therealong in guided axial movement to provide reciprocal axial movement for the slide assembly 48.

The distal end of first operator arm 70 on first pivot lever 68 has a hole 77 therein. The bottom end of operator link 7 is secured to aperture 77 and extends upwardly therefrom to the conventional rotary latch 8. Therefore, when first L-shape pivot lever 68 is moved in a clockwise direction around pivot post 71 by slide assembly actuation, as viewed in FIG. 4, the distal end of the operator arm 70 and the link 7 are moved downwardly to unlatch the rotary latch mechanism to allow the door to be opened.

The pivotal lever assembly 67 of the present invention may also include a second L-shape pivot lever, indicated generally at 80. The second L-shape pivot member includes an integrally formed second actuator arm 81 and a second operator arm 82. The second pivot lever is pivotally mounted to the first pan 13 by a second pivot post 83 mounted on and extending inwardly from the first guide plate 54. The second pivot post 83 is in vertical alignment with but spaced downwardly from the first pivot post 71. The second pivot post 83 has the second pivot lever 80 pivotally connected thereto at the intersection of the second actuator arm 81 and second operator arm 82 adjacent the distal end of each. Thus, the second actuator arm 81 and second operator arm 82 are free to pivotally rotate about such second pivot post 83.

The distal end of the second actuator arm 81 is provided with an elongated slot (not shown) which receives the actuator pin 74 extending upwardly from first slide member 49. The distal end of the first actuator arm 69 on first pivot lever 68 is superimposed above the distal end of the second actuator arm 81 on second pivot lever 80, with the actuator pin 74 commonly passing through elongated slots on both. Thus, axial movement of such pin 74 caused by axial movement of the first slide member 49 will pivotally drive the first and second pivot levers 68 and 80 about their respective pivot posts 71 and 83. The first and second pivot levers 68 and 80 will be moved in opposite arcuate directions by movement of such slide assembly.

The distal end of the second operator arm 82 has a hole 85 therein. The bottom operator link 7A is connected to such hole 85 and extends downwardly therefrom to a lower conventional rotary latch assembly. Pivotal movement of the second pivot lever 80 in a counter-clockwise direction as viewed in FIG. 4 about second pivot post 83 will elevate operator arm 82 and operator link 7A to unlatch the lower conventional lower latch assembly to allow the door to be opened.

The first pivot lever 68 and second pivot lever 80 are normally simultaneously urged in opposite angular directions to return the slide assembly and handles to their normal, "closed" operating positions. For this purpose, a torsion spring 87 has its upper end 88 secured to the bottom edge of first operator arm 70 to bias the first pivot lever 68 in a counter-clockwise direction about pivot post 71 as viewed in FIG. 4. The other end 89 of torsion spring 87 is secured to the upper edge of second operator arm 82 normally to bias the second pivot lever 80 in a counterclockwise direction about second pivot post 83 as viewed in FIG. 4. The torsion spring 87 between its ends 88 and 83 extends between and is coiled around spaced pivot posts 71 and 83.

By biasing first pivot lever 68 in a counter-clockwise direction and second pivot lever 80 in a clockwise direction, the distal ends of first actuator arm 69 and second actuator arm 81 are being urged to the right as viewed in FIG. 4 or to the left as viewed in FIG. 2. Such biasing urges pin actuator 74 on first slide member 49 to the right as viewed in FIG. 4 to return the slide assembly to the right to pivot the actuation finger about its pivot shaft to return the actuated handle to its retracted position in its pan assembly when that handle is released.

Although the operation of nested paddle lock assembly when in its unlocked condition is believed to be apparent from the above, a brief description of that operation will be included for purposes of completeness. This operational description begins with the outside and inside paddle handles received in their respective outside and inside pans and with the locking assembly in an unlocked condition permitting freedom of slide assembly movement.

To open the door from outside the vehicle 1, a person pulls on paddle handle 22A to pivot the same outwardly from first pan 13 to the dotted line position 22A. The pivotal movement of the paddle handle 22A results in the first actuation finger 26 pivoting about pivot shaft 23 in a clockwise direction as viewed in FIG. 2. The first actuation finger 26 drives first slide member 49 to the right resulting in the actuation pin 74 also moving to the right, as viewed in FIG. 2. This pin movement is directed toward the left when viewed from the inside cavity of the door as shown in FIG. 4. The axial movement of first slide member 49 from its home or closed position toward its open position is independent of any movement in the second slide member 59 because there is no drive or overlapping contact therebetween.

As a result of such actuation pin passing through superimposed elongated slots 73 in the distal ends of the actuation arms 69 and 81 of the first and second pivot levers 67 and 80, respectively, any axial sliding movement of actuator pin 74 results in opposite arcuate movement of the first and second pivot levers about their respective pivot posts 71 and 83. In this regard, as viewed in FIG. 4, pivot lever 68 is pivoted in a clockwise direction while second pivot lever 80 is pivoted in a counter-clockwise direction. This pivotal movement of the pivot lever results in the operator arms 70 and 82 thereof actuating operator links 7 and 7A, respectively, to unlatch the conventional upper and lower rotary latches 8 to allow the door to be swung to its open position as viewed in FIG. 2.

When outside paddle handle 22 is released, the ends 88 and 89 of torsion spring 87 urge the first and second pivot levers 70 and 82, respectively, in opposite arcuate directions. Specifically, as viewed in FIG. 4, first pivot lever 68 is spring biased a counter-clockwise direction, and second pivot lever 80 is spring biased in a clockwise direction. This pivotal movement of the pivot levers drives the actuator pin 74 passing through the distal ends of the first and second actuator arms 69 and 81, respectively, toward the right as viewed in FIG. 4 or toward the left as viewed in FIG. 2. Since the first slide member 49 has an actuator pin 74 connected and extending inwardly from the base member 52 thereof, axial movement of the actuator pin 74 drives the first slide member 49 to the right as viewed in FIG. 4 toward its closed position. This movement is stopped at the "closed" position of the slide assembly by actuator pin 74 reaching the end of the fixed slot 75 on the guide bracket 54. During the return movement of the actuator pin 74 and first slide member 49, the actuator flange 50 of first slide member 49 drives the first actuation finger 26 in a counterclockwise direction as viewed in FIG. 2 because of the contact therebetween. Counter-clockwise movement of actuator finger 22 returns the handle 22 under spring bias to its retracted position within the well 17 of first pan 13. The bias of spring 87 thus resets the latches, returns the slide assembly to its closed position and returns handle 22 to its retracted position in the well of the outside pan.

To open the closed door from the inside, second paddle handle 41 is pivoted away from the second pan 31 to the dotted line position 41A shown in FIG. 2. This pivotal handle movement results in second actuation finger 43 pivoting counter-clockwise around pivot shaft 42 to the dotted line position 43A shown in FIG. 2. Because second actuation finger 43 abuts second actuation flange 60, the counterclockwise pivotal movement of second actuation finger 43 drives second slide member 59 to the right as viewed in FIG. 2. Because second abutment flange 61 is positioned behind and in overlapping relationship with first abutment flange 51, linear movement of second slide member 59 to the right as viewed in FIG. 2 from its closed to its open position also drives first slide member 49 to the right as viewed in FIG. 2 from its closed to its open position. The driven linear movement of the first slide member 49 and its actuator pin 74 pivots the pivot lever assembly 67 to operate the conventional rotary latches 8, as described above.

When second or inside paddle handle 41 is released, torsion spring 87 will reverse the opposite arcuate movements of the first and second pivot levers 68 and 80, respectively, to drive the actuator pin 74 and first slide member 49 to the left as viewed in FIG. 2. Because first abutment flange 51 on first slide member 49 is now behind and in overlapping relationship with second abutment flange 61 on second slide member 59, the second slide member 59 is also returned to the left as viewed in FIG. 2. Such linear movement to the left as viewed in FIG. 2 (or to the right as viewed in FIG. 4) from the open to the closed position of the slide assembly results in second actuation flange 60 on second slide member 59 driving second actuation finger 43 on handle 41 in a clockwise direction as viewed in FIG. 2. This clockwise pivotal movement under the bias of spring 87 returns the handle 41 to its retracted position in the well 40 of second pan 31.

As is apparent from the above, torsion spring 87 biases the first and second pivot levers, the actuator pin 74 and the first and second slide members 49 and 59 respectively, toward their closed or starting positions. As such, first actuation flange 50 and second actuation flange 60 are respectively biased against first actuation finger 26 and second actuation finger 43 positively to retain the outside paddle handle 22 and inside paddle handle 41 in their retracted positions within the respective wells of the first pan 13 and second pan 31, respectively. Such positive spring bias provided by torsion spring 87 reduces the amount of paddle handle rattle in the outer and inner pan assemblies 11 and 29, respectively, thereby to provide a quieter ride.

The operation of the nested paddle lock assembly of the present invention has just been described when the locking mechanism, indicated generally at 91, is in its unlocked condition allowing the first and second U-shape slide members 49 and 59, respectively, of the slide assembly 48 freedom of reciprocal linear movement relative to the two pan assemblies. The locking mechanism 91 of the present invention in its locked condition as illustrated in FIG. 2 precludes linear movement of the slide assembly by positioning the lock pin to block the slide assembly movement. Since the slide assembly 48 cannot move when the lock is applied, neither paddle handle can be pivoted outwardly from its respective pan.

In the locking mechanism 91, the outside pan assembly 11 has an outside key operated locking cylinder assembly, indicated generally at 92. This first or outside locking cylinder assembly 92 selectively cooperates with an inside or second locking cylinder assembly, indicated generally at 93. The inside locking cylinder assembly 93 is mounted on the second pan 31 of inside pan assembly 29.

Turning first to the outside key operated locking cylinder assembly 92, the outside shell 95 thereof is positioned in the well 17 of first pan 13. The inner surface of the outside shell 95 is tightly secured against the outer surface of the base member 16 of pan 13. The outer shell 95 has a key slot 96 therein adapted to receive a key of complementary configuration. The key can only be inserted into or removed from the key slot 96 when that key slot is in the vertical orientation illustrated in FIG. 3.

Selective pivotal movement of the key in key slot 96 in 90° increments in either a clockwise or counterclockwise direction from the vertical orientation will correspondingly rotate the first or outer cylinder 97. Such cylinder 97 passes through a hole in base wall 16 of first pan 13 and extends into cavity 21 in the door, as best shown in FIGS. 2 and 4. The first or outer cylinder 97 has a set of circumferentially spaced, wedge shape drive shoulders adjacent the second or inner end thereof as identified by reference numerals 98A and 98B. This set of wedge shape drive shoulders selectively rotatably cooperates with a second set of drive shoulders on the second or inner locking assembly 93.

Such inner locking assembly includes an inside shell 100 mounted in the well 40 of second pan 31. In this regard, the bottom surface of inside shell 100 is tightly secured against the surface of base wall 35 of second pan 31. As best shown in FIG. 5, the inside shell 100 has a hand actuation knob 101 mounted thereon. Such actuation knob 101 has 90° of arcuate movement only to allow the inside locking cylinder 102 to be selectively pivoted through a 90° arcuate extent.

The inner or second locking cylinder 102 passes through a hole in the base wall 35 of the second pan 31 and extends into the cavity 21 of door 3 as best shown in FIGS. 2 and 6. The second or pivotal locking cylinder 102 has a locking pin 103 connected thereto and extending outwardly therefrom. The inner locking cylinder 102 also has a second set of circumferentially spaced, flange shape shoulders 105A and 105B thereon which selectively cooperate with the first set of shoulders 98A and 98B on first locking cylinder 97. Actuation of the outer key slot 96 or inner knob 101 can drive the locking pin 103 to one of two positions.

In this regard, the locking pin 103 has a first or "unlocked" position best shown in dotted lines 103A FIG. 6 wherein the pin 103 extends downwardly as viewed therein resulting in removing obstruction to linear reciprocal movement of the slide assembly 48. In its other "locked" position, the locking pin 103 is positioned 90° from its unlocked position and extends into abutment with the first abutment flange 51 on first U-shape slide member 49 when the slide assembly 48 is in its closed position with the handles retracted in the respective wells of first and second pan assemblies 13 and 31, respectively. The abutment of locking pin 103 against the slide assembly 49 precludes the slide assembly from being moved. Therefore, outside paddle handle 22 and inside paddle handle 41 cannot be pivotally pulled away from their respective pan assemblies. Such locking pin 103 in its locking position thus provides a direct lock to the slide assembly.

The inside cylinder 102 is provided with a conventional spring loaded ball bearing detent (not shown). This ball bearing detent positively holds the inside locking cylinder in its unlocking position with the locking pin 103 positioned out of the path of slide assembly travel or in its locked position with the locking pin 103 in abutment with the slide assembly to prelude linear movement of the same.

Although operation of the inner and outer locking cylinder assemblies 92 and 93, respectively, is believed apparent from the above-description, the following discussion is included for purposes of completeness. This discussion of operation begins with the locking pin in its locked position, the inner knob 101 in its resultant horizontal position, and the key slot in its neutral vertical position.

To unlock the door from inside the vehicle, the inner knob 101 is merely rotated 90° in a clockwise direction as viewed in FIG. 5 to move the knob 101 to its detented vertical orientation. As oppositely viewed in FIG. 6 from the inside cavity of the door, the rotation of the knob will result in counter-clockwise movement of the second or inner locking cylinder 102 and shoulders 105A and 105B. As is apparent from FIG. 6, the wedge shape shoulders 98A and 98B on first locking cylinder 97 are spaced 90° from shoulders 105A and 105B to permit the 90° rotation of second locking cylinder 102. At the conclusion of this rotation, shoulder 105A will abut wedge shape shoulder 98B and shoulder 105B will abut wedge shape shoulder 98A. This rotation moves the locking pin 103 to its downwardly extending unlocked position 103A.

To then return the handle assembly to the locked condition from inside vehicle 1, the knob 101 as viewed in FIG. 5 is rotated in a counter-clockwise direction back to its horizontal detented position. As oppositely viewed in FIG. 6, actuation of knob 101 will result in clockwise rotation of second cylinder 102 to return the locking pin 103 to its horizontal locked position abutting slide assembly 48. Clockwise rotation of second cylinder 102 will return flange shoulder 105A into abutment with wedge shape shoulder 98A and flange shoulder 105B into abutment with wedge shape shoulder 98B.

To unlock the lock mechanism from outside the door, with the lock mechanism being in its stated and illustrated position, the key and key slot are pivoted in a counter-clockwise direction as viewed in FIG. 3. As oppositely viewed in FIG. 4 from the inside cavity of the door, this key actuation will result in the first locking cylinder 97 and wedge shape shoulders 98A and 98B rotating in a clockwise direction. The abutment between shoulders 98A and 105A and between shoulders 98B and 105B will rotate the second or inner cylinder 102 to move the locking pin 103 from its horizontal locked position to its vertical unlocked position 103A.

After unlocking is completed, the key and key slot 96 are returned in a clockwise direction to the neutral vertical position allowing the key to be removed from the slot. As a result of this return key movement, as oppositely viewed in FIG. 4, the first locking cylinder is rotated in a counter-clockwise direction to position wedge shape shoulder 98A in abutment with flange shape shoulder 105B and wedge shape shoulder 98B in abutment with flange shape shoulder 105A.

To now relock the door from outside the door, the key is reinserted into key slot 96 and the key and key slot are rotated in a clockwise direction as viewed in FIG. 3. As oppositely viewed in FIG. 4, this key rotation will result in counter-clockwise rotation of first locking cylinder 97 and wedge shape shoulders 98A and 98B. Wedge shape shoulders 98A and 98B will drive flange shoulders 105B and 105A respectively in abutment therewith to rotate second locking cylinder 102 to return locking pin 103 to its horizontal locked position.

After locking is completed, the key and key slot are rotated in a counter-clockwise direction to return the key and key slot to their vertical neutral position to allow removal of the key. Such return movement rotates the first locking cylinder in a clockwise direction as viewed in FIG. 4 to return wedge shape shoulder 98A into abutment with flange shoulder 105A and wedge shape shoulder 98B into abutment with flange shape shoulder 105B.

As is apparent from the above, the nested paddle lock assembly 5 of the present invention permits easy installation and maintenance. If a malfunction occurs, the inner pan assembly 29 can be unscrewed from the inner door panel 30 and removed from the door since no interconnection exists between the nested inner and outer pan assemblies. By removing the inner pan assembly, access is directly provided to the removed inner pan assembly 29 and inner locking mechanism 93 and is provided through the opening 38 in the inner door panel 30 to the first or outer pan assembly 11 and first or outer locking mechanism 92.

It will be apparent from the foregoing that changes may be made in the details of construction and configuration without departing from the spirit of the invention as defined in the following claims.

We claim:

1. A nested paddle lock assembly for a vehicle door or the like comprising:

an outside pan assembly mounted to an outside door surface, said outside pan assembly including a first pan partially received in the door and a first outside paddle handle pivotally mounted to and normally received within the first pan and including a first actuation finger extending into the door;

an inside pan assembly mounted to an inside door surface in alignment with said outside pan assembly, said inside pan assembly including a second pan partially received in said door and a second inside paddle handle pivotally mounted to and normally received within the second pan and including a second actuation finger extending into the door;

a slide means mounted to said first and second pans and being reciprocally linearly movable relative thereto between a closed position and an open position, said first or second actuation fingers engaging said slide means to drive the same through a first linear movement from the closed position to the open position when either the inside or outside handle is pivoted away from the door;

a pivotal lever means actuated by said first linear movement of the slide means from its closed to its open position and operative upon actuation to unlatch the door for opening; and lock means including a pivotal outside lock actuator mounted to said first pan and a pivotal inside lock actuator mounted to said second pan, selected pivotal movement of either the inside or outside lock actuator to a locking position obstructing slide means movement and locking the slide means in its closed position to preclude door opening.

2. The nested paddle lock assembly of claim 1 wherein the pivotal lever means includes a first L-shape lever having a first actuation arm, a first operator arm and a first pivotal connection therebetween to the first pan.

3. The nested paddle lock assembly of claim 2 wherein the slide means has an actuation pin mounted thereon, said actuation pin being received in a first slot in the distal end of the first actuation arm of the first L-shape lever, whereby linear movement of the slide means and actuation pin will pivotally actuate the first L-shape lever and vice versa.

4. The nested paddle lock assembly of claim 3 wherein the first operator arm has a first link connected thereto adjacent its distal end and extending therefrom to a first rotary latch assembly adapted selectively to latch the door in a closed position, whereby pivotal movement of the first L-shape lever caused by linear movement of the slide means from its closed to its open position results in first link movement to open the first rotary latch assembly to unlatch the door.

5. The nested paddle lock assembly of claim 4 wherein the pivotal lever means includes a second L-shape lever having a second actuation arm, a second operator arm and a second pivotal connection therebetween to the first pan, said actuation pin also being received in a second slot in the distal end of the second actuation arm, with the distal ends of the first and second actuation arms being superimposed relative to one another, whereby linear movement of the slide means and actuation pin will pivotally actuate the first and second L-shape levers in opposite arcuate directions.

6. The nested paddle lock assembly of claim 5 wherein the second operator arm has a second link connected thereto and extending therefrom to a second rotary latch assembly also adapted selectively to latch the door in a closed position, whereby pivotal movement of the second L-shape lever caused by linear movement of the slide means and actuation pin from its closed to its open position results in second link movement to open the second rotary latch assembly to unlatch the door.

7. The nested paddle lock assembly of claim 6 wherein the pivotal lever means further includes spring means normally oppositely biasing the first and second L-shape levers oppositely to pivot the same about their respective spaced apart pivotal connections to the first pan for returning the actuation pin and slide means in a linear direction to the closed position of the slide means when the first or second paddle handle is released to return the first or second paddle handle to its normal position within its respective pan.

8. The nested paddle lock assembly of claim 7 wherein said spring means is a torsion spring, which through the L-shape lever arms, actuation pin and slide means, normally urges one end of the slide means against the first and second actuation fingers to minimize rattle in the first and second paddle handles.

9. The nested paddle lock assembly of claim 3 or claim 9 wherein the slide means includes a first generally U-shape slide member adapted to slide linearly relative to the first pan, and a second generally U-shape slide member adapted to slide linearly relative to the second pan.

10. The nested paddle lock assembly of claim 9 wherein said first U-shape slide member has a first actuation flange at one end, a first abutment flange at the other end and a first slide base extending therebetween and said second U-shape slide member has a second actuation flange at said one end, a second abutment flange at said other end and a second slide base extending therebetween.

11. The nested paddle lock assembly of claim 11 wherein the first pan has a first slide guide plate mounted thereon, said first guide plate having a first guide channel with said first slide base slidably extending therethrough and being guided thereby, and wherein the second pan has a second guide plate mounted thereon, said second guide plate having a second guide channel with said second slide base slidably extending therethrough and being guided thereby.

12. The nested paddle lock assembly of claim 11 wherein said actuation pin is mounted on the first slide base and extends through an elongated slot in said first guide channel to its connection with said pivotal lever means, said elongated slot providing limited freedom for reciprocal sliding movement of said slide means.

13. The nested paddle lock assembly of claim 12 wherein at least one of said first and second abutment flanges is longer than at least one of said respective first and second actuation flanges, the first and second slide members being respectively mounted on their first and second pans to have the first and second actuation flanges thereof in aligned, but spaced relationship to one another and to have the first and second abutment flanges in overlapping and normally contacting relationship relative to one another.

14. The nested paddle lock assembly of claim 13 wherein the second abutment flange is positioned behind said first abutment flange in said overlapping relationship, and said first and second actuation fingers are respectively in engagement with said first and second actuation flanges, whereby pivotal movement of the first outside paddle handle when unlocked will move the first actuation finger and first slide member (independent of the second slide member, second actuation finger and second paddle handle) to operate the pivotal lever means through the actuation pin connection provided in the first slide member and whereby pivotal movement of the second inside pivotal handle when unlocked will move the second actuation finger, second slide member and first slide member (independent of the first actuation finger and first paddle handle) to operate the pivotal lever means through the actuation pin connection provided on the first slide member.

15. The nested paddle lock assembly of claim 1 wherein the pivotal outside lock actuator is key operated and has a first cylinder with a first set of circumferentially spaced shoulders thereon, and said pivotal inside lock actuator is manually operated and has a second cylinder with a second set of circumferentially spaced shoulders thereon, said first and second sets of shoulders selectively engaging one another to move the lock means to a locked or unlocked position from either inside or outside the door.

16. The nested paddle lock assembly of claim 15 wherein the second cylinder has a locking pin mounted thereon and extending outwardly therefrom, said locking pin being rotated to a locked position when the lock means is locked to engage said slide means to preclude movement thereof and being rotated to an unlocked position when the lock means is unlocked to be out of engagement with said slide means to permit selective reciprocal movement thereof.

17. A nested paddle lock assembly comprises inside and outside pan assemblies mounted in alignment with one another on a door and respectively having inside and outside selectively pivotal paddle handles, slide means in said door selectively linearly actuated by either handle when pulled, pivotal lever means pivoted by said linearly moving slide means upon handle actuation to unlatch said door, spring means to return the pivotal lever means, slide means and handles to their respective normally closed positions and lock means selectively actuated from inside or outside the door either to lock the door by obstructing slide means movement or to unlock the door by allowing slide means movement.

* * * * *